US005902784A

United States Patent [19]

Hellsten et al.

[11] Patent Number: 5,902,784

[45] Date of Patent: May 11, 1999

[54] USE OF A BETAINE SURFACTANT TOGETHER WITH AN ANIONIC SURFACTANT AS A DRAG-REDUCING AGENT

[75] Inventors: Martin Hellsten, Ödsmål; Ian Harwigsson, Malmö, both of Sweden

[73] Assignee: Akzo Nobel nv, Arnhem, Netherlands

[21] Appl. No.: 08/913,120

[22] PCT Filed: Mar. 5, 1996

[86] PCT No.: PCT/EP95/00950

§ 371 Date: Sep. 8, 1997

§ 102(e) Date: Sep. 8, 1997

[87] PCT Pub. No.: WO96/28527

PCT Pub. Date: Sep. 19, 1996

[30] Foreign Application Priority Data

Mar. 9, 1995 [SE] Sweden ..... 9500841

[51] Int. Cl.[6] ..... C11D 1/94

[52] U.S. Cl. ..... 510/427; 510/490; 137/13

[58] Field of Search ..... 510/410, 237, 510/427, 490, 235; 137/13; 166/308; 507/922

[56] References Cited

U.S. PATENT DOCUMENTS

| | | | |
|---|---|---|---|
| 3,768,565 | 10/1973 | Persinski et al. | 166/308 |
| 4,152,274 | 5/1979 | Philips et al. | 252/8.55 |
| 4,436,846 | 3/1984 | Krantz | 523/175 |
| 4,505,827 | 3/1985 | Rose et al. | 252/8.55 |
| 4,595,526 | 6/1986 | Lai | 252/545 |
| 4,615,825 | 10/1986 | Teot et al. | 252/356 |
| 5,143,635 | 9/1992 | Young et al. | 252/34 |
| 5,339,855 | 8/1994 | Hellsten et al. | 137/13 |
| 5,486,307 | 1/1996 | Misselyn et al. | 252/174.24 |
| 5,607,980 | 3/1997 | McAtee et al. | 514/476 |
| 5,696,073 | 12/1997 | Jakubicki et al. | 510/426 |

FOREIGN PATENT DOCUMENTS

| | | | |
|---|---|---|---|
| 0 091 086 | 3/1983 | European Pat. Off. | F15D 1/00 |
| WO 95/11288 | 4/1997 | WIPO | C10M 133/06 |

*Primary Examiner*—Paul Lieberman
*Assistant Examiner*—Gregory E. Webb
*Attorney, Agent, or Firm*—Ralph J. Mancini

[57] ABSTRACT

A combination of at least one betaine surfactant having an saturated or unsaturated alkyl or acyl group having 10–24 carbon atoms, preferably 14–24 carbon atoms, and an anionic surfactant having the general structure $R_1$—B where $R_1$ is a hydrocarbon group with 10–24 carbon atoms and B is a group

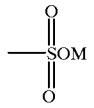

or a group

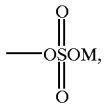

in which M is hydrogen or a cationic, preferably monovalent group in a proportion between the betaine surfactant and the anionic surfactant of from 20:1 to 1:2, preferably from 10:1 to 1:1, reduces the flow resistance between a flowing water-based liquid system and a solid surface.

16 Claims, No Drawings

USE OF A BETAINE SURFACTANT TOGETHER WITH AN ANIONIC SURFACTANT AS A DRAG-REDUCING AGENT

The present invention relates to the use of a betaine surfactant together with an anionic, surface active sulphate or sulphonate in a water-based system for reducing the flow resistance between a solid surface and the water-based liquid system.

Surfactants with the ability to form extremely long, cylindrical micelles have, in recent years, attracted a great interest as drag-reducing additives to systems with circulating water, especially those destined for heat or cold distribution.

An important reason for this interest is that, although one desires to maintain a laminar flow in the conduits, one wishes at the same time to have turbulence in the heat exchangers to achieve therein a high heat transfer per unit area.

As may easily be understood, fibres or chain polymers are unable to provide this double function which, however, can be achieved with thread-like micelles, since the flow rate (the Reynold's number) usually is much higher in the heat exchangers than in the conduit.

The thread-like micelles are distinguished by operating in a fairly disorderly fashion at low Reynold's numbers (below $10^4$), having no or only a very slight effect on the flow resistance. At higher Reynold's numbers (above $10^4$), the micelles are paralleled and result in a drag reduction very close to that which is theoretically possible. At even higher Reynold's numbers (e.g. above ($10^5$), the shear forces in the liquid become so high that the micelles start to get torn and the drag-reducing effect rapidly decreases as the Reynold's number increases above this value.

The range of Reynold's numbers within which the surface-active agents have a maximum drag-reducing effect is heavily dependent on the concentration, the range increasing with the concentration.

By choosing the right concentration of surface-active agents and suitable flow rates in tubings and heat exchangers, it is thus possible to establish a laminar flow in the tubes and turbulence in the heat exchangers. Thus, the dimensions of both the tubes and the exchangers can be kept at a low level, or the number of pump stations, and consequently the pump work, can alternatively be reduced while retaining the same tubular dimensions.

The surface active agents most commonly used as drag-reducing additives to circulating water systems for heat or cold distribution are of the type represented by alkyltrimethyl ammonium salicylate, wherein the alkyl group is a long alkyl chain which has 12–22 carbon atoms and which may either be saturated or contain one or more double bonds.

This type of surface-active agent functions satisfactorily already at a concentration of 0.5–2 kg/m$^3$, but is degraded very slowly, both aerobically and anaerobically, and further is highly toxic to marine organisms.

Since heat-distribution systems for small houses usually suffer from important leaks (it is estimated that in one year 60–100 per cent of the water leaks out), it follows that the added chemicals end up in the ground water and in various fresh-water recipients. This combination of low biodegradability and high toxicity is a fundamental criterion for a product injurious to the environment.

Thus there is a general demand for surface-active agents which are less harmful to the environment but which have the same excellent ability as the quaternary ammonium compounds described above to reduce the flow resistance in circulating water systems.

In the U.S. Pat. No. 5,339,855 it is described that alkoxylated alkanolamides with the general formula

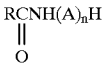

wherein R is a hydrocarbon group having 9–23 carbon atoms, A is an alkyleneoxy group having 2–4 carbon atoms and n is 3–12, are capable of forming long cylindrical micelles in water and thus reduce the drag in water-based system.

These products are easily degradable and function excellently in deionized water especially at low temperatures. However, the drag-reducing effects are hampered in hard water and by the presence of high amounts of electrolytes. Further the temperature range for their optimal drag-reducing effect will be rather narrow, sometimes as small as 10° C.

SE-C2-500 923 discloses the use of amphoteric surfactants as friction reducing agents in water-based systems. The amphoteric compounds, which contain one or more primary, secondary or tertiary amine groups and one or more carboxylic groups, have shown a high dependency on the pH-value of the water-based system.

It has now surprisingly been found that essential improvments is achieved by the use of at least one betaine surfactant having a saturated or unsaturated alkyl or acyl group with 10–24, preferably 14–24 carbon atoms in combination with an anionic surfactant having the general structure

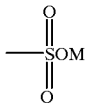

where $R_1$ is an hydrocarbon group with 10–24 carbon atoms and B is a group or a group

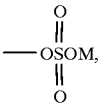

in which M is a cat ionic, preferably monovalent group, in a proportion between the betaine surfactant and the anionic surfactant of from 20:1 to 1:2, preferably within 10:1 to 1:1, for producing a water-based liquid system with low flow resistance between the flowing water-based liquid system and a solid surface. The betaine surfactant has preferably the general formula

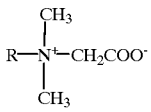

(I)

where R is the alkyl group or the group $R'NC_3H_6$— where R' is the acyl group. The hydrophobic group $R_1$ can be aliphatic or aromatic, straight or branched, saturated or unsaturated. The cationic group B is suitably an alkali group like sodium or potassium. By "water-based" is meant that at least 50% by weight, preferably at least 90% by weight, of the water-based liquid system consists of water. Both the betaine surfactant and the anionic surfactant are readily degradable and the combination gives an excellent drag reducing effect within a wide temperature range. Thus, the drag-reducing additives may be used in a cooling media at temperatures below 30° C., when, for example using betaine surfactants, where the alkyl or acyl group has 14–16 carbon atoms, and in a heat-transfer medium at a temperature in the range of 50–120° C., when, for example using betaine surfactants where the alkyl or acyl group contains 18 carbon atoms or more, preferably 18–22 carbon atoms and one or two double bonds. The mixtures according to the invention can also tolerate hard water and electrolytes which may be added e.g. as corrosion inhibitors. The carbon numbers of the hydrophobic groups R, R' and $R_1$ will determine the useful temperature range for the mixture so that high carbon numbers will give products suitable for high temperatures.

Furthermore, the betaine and anionic surfactants are suitably chosen in such a manner that the crystallization temperature for the combination is suitably below the lowest temperature for which the water-based system is intended.

The total amount of the betaine surfactant and the anionic surfactant may vary within wide limits depending on the conditions but is generally 0.1–10 kg/m$^3$ of the water-based system.

The solution of the betaine and anionic surfactant is especially suited for use in water-based systems flowing in long conduits, e.g. circulation water systems for heat and cold distributions.

The betaine surfactant can be produced by reacting a N-alkyl-N, N-dimethylamine or a N'-acyl-N,N-dimethyl-1,3 diaminopropane with Na-chloroacetate at 70–80° C. and a constant pH-value of 9.5 in a medium of a lower alcohol or water. To obtain a good drag reducing effect it is essential that the amount of the amine reactant in betaine product used is low. Preferably it should be lower than 5% by weight and most preferably lower than 2% by weight of the betaine surfactant. If a low chloride content in the product is necessary the reaction can preferably be made in isopropanol with the lowest water content possible, whereby the sodium chloride formed in the reaction will crystallize out of the product and may be removed by filtration or centrifugation.

Another route to a chloride-free product is to quaternize the amine reactant with ethylene oxide and an acid catalyst and then dehydrogenate the resulting product to the desired betaine surfactant. The group R and R' in formula I can suitably be tetradecyl, hexadecyl, octadecyl, oleyl, rape seed alkyl and tallow alkyl or the corresponding acyl group.

The anionic surfactants suitable for use in accordance with the invention are well-known products and so are also the production methods. Typical examples are alkyl sulphates derived from fatty alcohols or synthetic alcohols, and alkyl arenesulphonates like decylsulphate, dodecylsulphate, cocoalkylsulphate, oleylsulphates, tallowsulphates and the corresponding sulphonates and dodecylbensensulphonates and hexadecylbensensulphonate.

The choice of the anionic surfactant will depend on the hardness, the salt content and the temperature of the water. In hard water alkylbensensulphonates are suitable due to the better solubility of their calcium salts.

A convenient way to determine the right proportion between the betaine surfactant and the anionic surfactant for a certain type of water is to make up a solution of e.g. 0.500 kg/m$^3$ of the betaine surfactant in the appropriate water in a glass beaker with a magnetic stirrer and keep the temperature in the middle of the intended temperature range for the system. This solution is then titrated with a solution of the anionic surfactant with a concentration of 10 kg/m$^3$ in deionized water until the originally formed vortex has disappeared.

The details of this procedure are described in more detail under the heading "Screening test".

Apart from the betaine and anionic surfactant, the water-based system may contain a number of conventional components such as rust-preventing agents, anti-freeze and bactericides.

The present invention will now be further illustrated with the aid of the following examples.

EXAMPLES

The drag-reducing properties of the compositions and products according to the prior art have been tested according to two different methods, one rather simple procedure, which will be called the screening test, and one more elaborated streaming test, which will be called the loop test.

Screening test

A serie of 50 ml glass beakers of the same dimensions (65×35 mm) each containing a Teflon-covered cylindrical magnet (20×6 mm) were each filled with 40 ml test solution and then placed on a magnetic stirrer, a thermometer immersed to a depth of 15 mm, the stirrer started at full speed, 1400 rpm, and the depth of the vortex formed in the solution was recorded at various temperatures.

When no vortex could be detected (recorded as 0 mm), it is known by experience that this indicates good drag reducing properties.

If on the other hand no efficient additive was present, e.g. for pure water the vortex reached down to the stirring magnet and the result was recorded as 35 mm.

Loop test

Measurements were carried out in a 6 m tube loop consisting of two straight and stainless tubes (3 m each), one tube having an inner diameter of 8 mm and the other having an inner diameter of 10 mm. Water was pumped through the tube loop by a centrifugal pump, which was driven by a frequency-controlled motor for continuous adjustment of the flow rate, which was determined by a rotameter.

The straight parts of the tube loop had outlets which, with the aid of valves, could in turn be connected to a differential pressure gauge whose other side was all the time connected to a reference point in the tube loop. Further, the tube loop was heat-insulated, and the suction side of the pump was connected to a thermostatically controlled container with a volume of 20 l, to which the return flow from the tube loop was directed.

After the test compound had been added and the aqueous solution had been thermostatically controlled, measurements began at low flow rates, and the pressure difference from two points on the 10 mm tube and three points on the 8 mm tube were measured for each flow rate. The pressure differences thus-measured were then converted into Moody's friction factor Y and are shown in the examples as a function of the Reynold's number Re.

$Y=2D.P_{diff}/V^2.L.d$ $Re=D.V.d/u$

D=tube diameter

V=flow rate

L=tube length over which the pressure difference $P_{diff}$ was measured d=density of the liquid u=viscosity of the liquid The examples also state the corresponding Prandtl number and Virk number. The former corresponds to the friction factor of water flow in turbulence, and the latter corresponds to flow without turbulence, i.e. a laminar flow.

Example 1

A modified sea-water was prepared by dissolving 38 g NaCl, 5 g $Ca(NO_3)_2 4\ H_2O$ and 5 g $MgSO_4$ to 1.00 liter of tap water containing 8 ppm $Ca^{2+}$.

In 40 mls of the water described above 43 mg active substance of N-hexadecyl betaine with the structure $$CH_3(CH_2)_{15}—N^+(CH_3)_2—CH_2COO^-$$

(in the following called $C_{16}$-betain) and 6.6 mg active substance of the sodium salt of a linear dodecylbenzenesulphonate with the structure.

$$C_{12}H_{25}—C_6H_4SO_3^-Na^+$$

(in the following called Na-LAS), were dissolved. This test solution was kept in a 50 ml glass beaker which also contained a 20 mm magnetic stirrer and was cooled down to +5° C. in a refrigerator and then tested at different temperatures from 8 to 24° C. The depth of vortex formed in mm at the stirrer speed of 1400 r.p.m. was measured. The following results were obtained.

| Temp. °C. | Vortex, mm | Appearance |
|---|---|---|
| 8 | 20 | cloud |
| 13 | 2 | cloud |
| 16 | 0 | slight cloud |
| 17.5 | 0 | haze |
| 19 | 1 | clear |
| 20 | 2 | clear |
| 22 | 3 | clear |
| 24 | 5 | clear |

From the results it is evident that the use of a alkyl chain having a length of 16 carbon atoms in combination with an anionic surfactant can be used for cold water applications.

Example 2

In 40 mls of deionized water 80 mg active substance of a $C_{18}$-betaine and 8 mg active substance of Na-LAS were dissolved. The structures of these compounds were the same as those given in Example 1 except that the $C_{18}$-betaine has an alkyl chain containing totally 18 carbon atoms. The test solution was tested in the same manner as in Example 1 at different temperatures from 30–90° C. The following results were obtained.

| Temp. °C. | Vortex mm |
|---|---|
| 30 | 1 |
| 40 | 0 |
| 50 | 0 |
| 60 | 0 |
| 70 | 0 |
| 80 | 0 |
| 90 | 2 |

The solution was clear in the whole temperature range.

The screening test in Example 2 indicates that a combination of $C_{18}$-betaine and Na-LAS has a good drag-reducing effect in the temperature range 30–88° C.

Examples 3–5

The tests were performed according to the loop test method. Deionized water was used in these tests.

The composition of the drag-reducing agent was 85 parts of $C_{18}$-betaine and 15 parts of Na-LAS and 0.5 kg/m$^3$ of this mixture was added in Example 3 and 4 and 2.0 kg/m$^3$ in Example 5. The temperature was 50° C. in Example 3, 85° C. in Example 4 and 98° C. in Example 5. The following results were obtained.

| Reynolds | Moody's friction factor × $10^3$ | | | | | |
|---|---|---|---|---|---|---|
| number | $6 \times 10^3$ | $10^4$ | $2 \times 10^4$ | $5 \times 10^4$ | $8 \times 10^4$ | $2 \times 10^5$ |
| Prandtl number | 36 | 32 | 27 | 21 | 19 | 15 |
| Example 3 | 36 | 20 | 16 | 21 | 18 | 15 |
| Example 4 | 18 | 13 | 7 | 5 | 18 | 15 |
| Example 5 | 36 | 28 | 29 | 21 | 16 | 13 |
| Virk number | 15 | 11 | 7 | 5 | 4 | 2.8 |

All values are calculated from measurements in the 8 mm tube. From these three loop tests it may be concluded that the combination of N-alkylbetaine and anionic surfactant used has good drag-reducing effect at least in the temperature range 50–85° C. and that this effect decreases substantially somewhere between 85 and 98° C. This results are in good agreement with the results from the screening tests in Example 2.

Example 6

A test solution was prepared by dissolved 60 mg active substance of $C_{18}$-betaine and 19 mg of sodium lauryl sulphate in 30 mls of deionized water. The pH value of the solution was 9.5. In the screening test this solution showed no vortex formation from 30° C. to 87° C.

Example 7

15 mg active substance of an amide between rape seed acids and N,N-dimethylpropylenebetaine having the structure of $$RCONHCH_2CH_2CH_2N^+(CH_3)_2CH_2COO^-$$

where RCO is derived from the fatty acids of rape seed oil. The fatty acid containing 60% by weight of oleic acid, 20% by weight of linoleic acid, 9% by weight of linolenic acid, 3% by weight of erucic acid and the rest mainly palmitic and stearic acids, was dissolved in 30 ml of deionized water together with 1.2 mg active substance of sodiumdodecylbenzenesulphonate. The pH of the solution was adjusted with NaOH to 9.8 and the speed of the magnetic stirrer to 1100 r.p.m.. The solution was heated slowly from room temperature up to 80° C. and the vortex depth observed in accordance with the screening test.

The following results were obtained.

| Temp, ° C. | 20 | 25 | 30 | 35 | 40 | 45 | 50 | 55 | 60 | 75 | 80 |
|---|---|---|---|---|---|---|---|---|---|---|---|
| Vortex mm | 35 | 20 | 5 | 5 | 3 | 0 | 0 | 0 | 0 | 1 | 10 |

These results show that this composition performs well as drag-reducing agent in the interval 30–75° C.

We claim:

1. A method for reducing the flow resistance between a flowing water-based liquid system and a solid surface which comprises adding to said water-based liquid system at least one betaine surfactant having a saturated or unsaturated alkyl or acyl group having 10–24 carbon atoms in combination with at least one anionic surfactant having the general structure $$R_1—B$$

where $R_1$ is a hydrocarbon group with 10–24 carbon atoms and B is a group

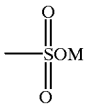

or a group

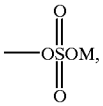

in which M is hydrogen or a cationic group, wherein the weight ratio between the betaine surfactant and the anionic surfactant is from 20:1 to 1:2.

2. The method of claim 1 wherein the betaine surfactant is of the general formula

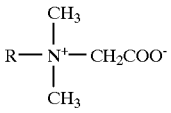

(I)

where R is the alkyl group or the group $R'NC_3H_6$— where R' is the acyl group.

3. The method of claim 2 wherein the crystallization temperature for the mixture is below the lowest temperature for which the water-based system is intended.

4. The method of claim 1 wherein the water-based system is heat-transfer medium with a temperature in the range of 50–120° C.

5. The method of claim 1 wherein the water-based system is a cooling medium with a temperature below 30° C.

6. The method of claim 1 wherein the mixture of betaine surfactant and anionic surfactant is added in an amount of 0.1–10 kg/m$^3$ of the water-based system.

7. The method of claim 1 wherein the alkyl group contains 18–24 carbon atoms.

8. The method of claim 7 wherein the alkyl group contains 18–22 carbon atoms and one or two double bonds.

9. The method of claim 1 wherein the acyl group contains 18–24 carbon atoms.

10. The method of claim 9, wherein the acyl group contains 18–22 carbon atoms and one or two double bonds.

11. The method of claim 1 wherein the alkyl group contains 14–16 carbon atoms.

12. The method of claim 1 wherein the acyl group contains 14–16 carbon atoms.

13. The method of claim 1 wherein $R_1$ is an alkylbenzene group and B is a sulphonate group.

14. The method of claim 1 wherein $R_1$ is an alkyl group and B is a sulphate group.

15. The method of claim 1 wherein the ratio between the betaine surfactant and the anionic surfactant is in the range of from 10:1 to 1:1.

16. The method of claim 1 wherein M is a monovalent cationic group.

* * * * *